United States Patent [19]

Bassler et al.

[11] Patent Number: 4,844,036

[45] Date of Patent: Jul. 4, 1989

[54] DEVICE FOR RETAINING, SUPPLYING FUEL TO AND PROVIDING ELECTRICAL CONTACT FOR ELECTROMAGNETICALLY ACTUATABLE FUEL INJECTION VALVES

[75] Inventors: Helmut Bassler, Weinstadt; Karl Gmelin, Flein; Heinz Ehrentraut, Stuttgart, all of Fed. Rep. of Germany

[73] Assignee: Robert Bosch GmbH, Stuttgart, Fed. Rep. of Germany

[21] Appl. No.: 237,030

[22] Filed: Aug. 29, 1988

[30] Foreign Application Priority Data

Sep. 11, 1987 [DE] Fed. Rep. of Germany ..... 3730571

[51] Int. Cl.[4] ..... F02M 39/00

[52] U.S. Cl. ..... 123/470; 123/468; 123/456

[58] Field of Search ..... 123/470, 471, 472, 468, 123/469, 456

[56] References Cited

U.S. PATENT DOCUMENTS 4,395,988 8/1985 Knapp ..... 123/470
4,474,159 10/1984 Katnik ..... 123/470
4,474,160 10/1984 Gartner ..... 123/470
4,556,034 12/1985 Anklam ..... 123/470
4,747,384 5/1988 Hafner ..... 123/470
4,756,289 7/1988 Rock ..... 123/468
4,776,313 10/1988 Freismuth ..... 123/468

*Primary Examiner*—Carl Stuart Miller
*Attorney, Agent, or Firm*—Edwin E. Greigg

[57] ABSTRACT

In known devices, the fuel injection valves, disposed in individual receiving bores, are retained individually with clamping shoes, and electrical contact is provided by individual electric plugs. The novel device is intended to assure that all the fuel injection valves are retained and provided with electrical contact simultaneously. The fuel injection valves inserted into receiving bores of a basic body are retained in common in the receiving bores by means of a contact-making outlet strip, slipped onto the basic body, and are electrically connected in common by means of electrically conductive contact elements. The entire compact device can be fastened as a unit to the engine and electrically connected, via a connection plug to an electronic control unit for trigging the fuel injection valves. The device makes adaptation to various engine types possible.

7 Claims, 3 Drawing Sheets

DEVICE FOR RETAINING, SUPPLYING FUEL TO AND PROVIDING ELECTRICAL CONTACT FOR ELECTROMAGNETICALLY ACTUATABLE FUEL INJECTION VALVES

BACKGROUND OF THE INVENTION

The invention relates to a device for retaining electromagnetically actuatable fuel injection valves as well as for supplying fuel to them and connecting them electrically. A device is already known from German Offenlegungsschrift No. 32 28 508 in which, the individual fuel injection valves, although they are received in individual receiving bores of a basic plastic body, must still be individually secured therein and provided individually with electrical contact.

OBJECT AND SUMMARY OF THE INVENTION

The device according to the invention has the advantage over the prior art that all the fuel injection valves disposed in the basic body can be simultaneously electrically connected via an outlet strip and retained in the basic body, so that with this compact unit, the fuel injection valves can be tested simultaneously and can then be secured as a unit to the intake tube or to the engine itself. Thus the various electric cables and plugs on the individual fuel injection valves, and individual clamping shoes for retaining the individual valves in the basic body, which are all required in the prior art, can be dispensed with.

The outlet strip is advantageously made of plastic and provided with an elastic snap-in connection that permits it to be connected to the basic body. This kind of snap-in connection assures that the basic body and the connection strip can be connected to one another quickly, yet easily and quickly released again. Moreover, the snap-in connection means the device does not need to be opened in the dirty engine compartment, so that the necessary work can be done in a desired manner at a clean work station.

Another advantage is attained by providing a receiving flange for a pressure regulating valve in the basic body, so that the pressure regulator is also part of the unit and can be secured with the unit to the engine.

The invention will be better understood and further objects and advantages thereof will become more apparent from the ensuing detailed description of a preferred embodiment taken on conjunction with the drawings.

DESCRIPTION OF THE PREFERRED EMBODIMENT

Figure 1:
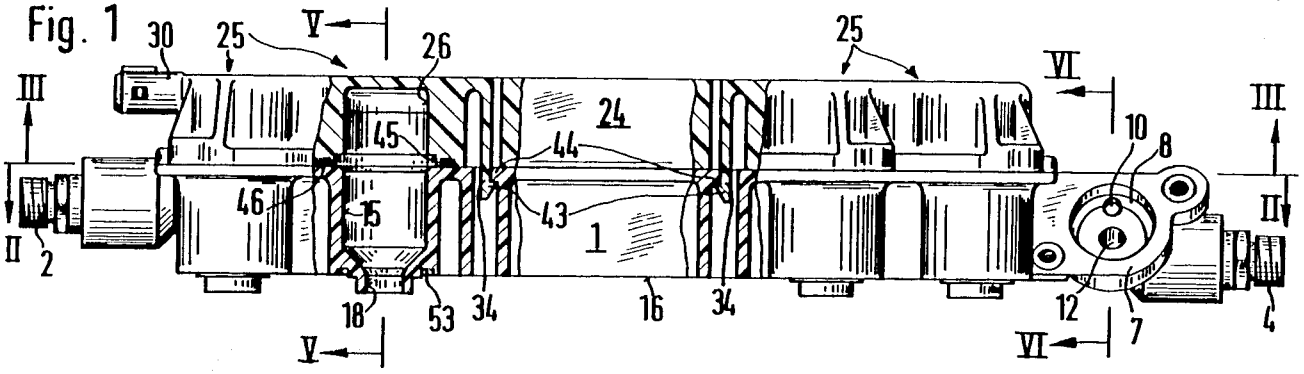
FIG. 1 is a partially cutaway view of the device according to the invention.
Figure 2:
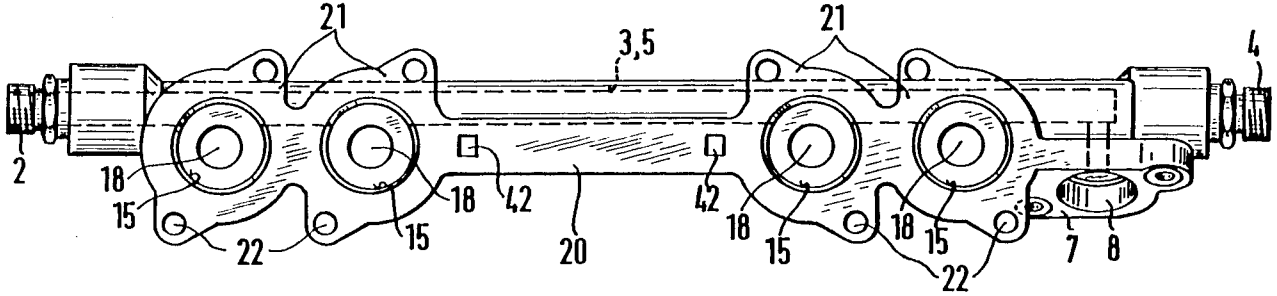
FIG. 2 is a section taken along the line II—II of FIG. 1.
Figure 3:
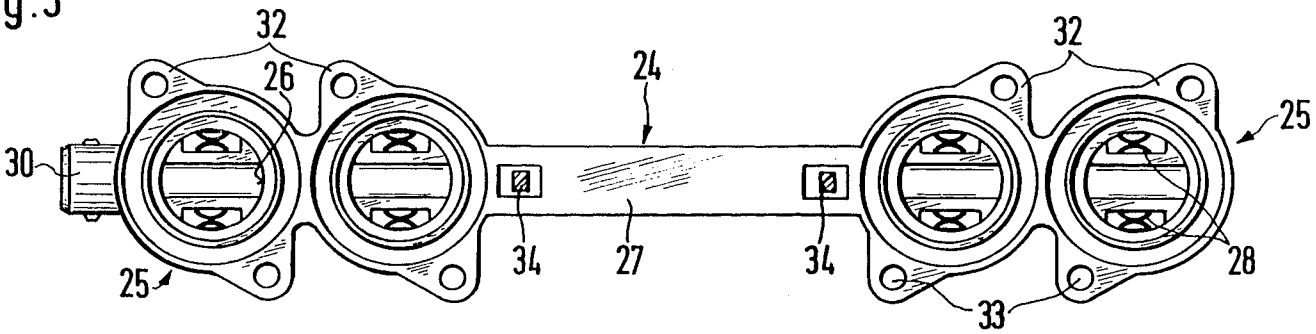
FIG. 3 is a section taken along the line III—III of FIG. 1.
Figure 4:
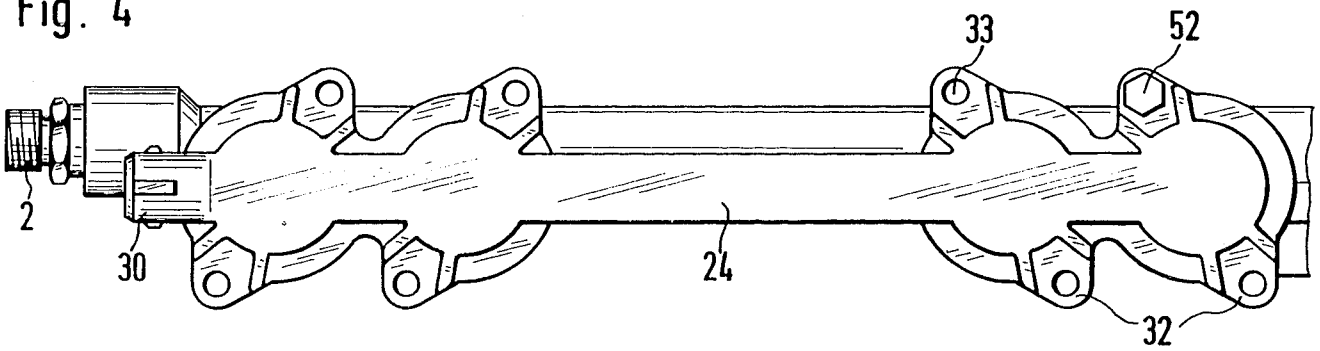
FIG. 4 is a plan view on the device according to the invention.
Figure 5:
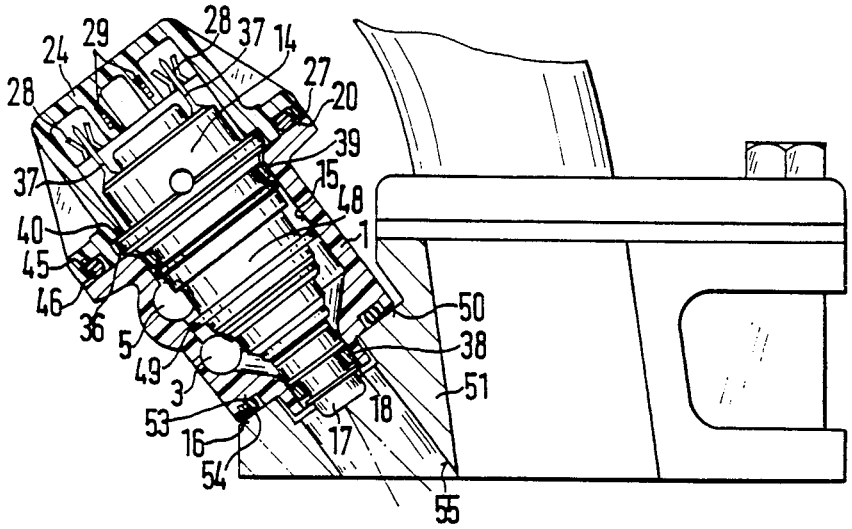
FIG. 5 is a sectional view taken along the line V—V of FIG. 1 showing the device in the position of installation on the engine.
Figure 6:
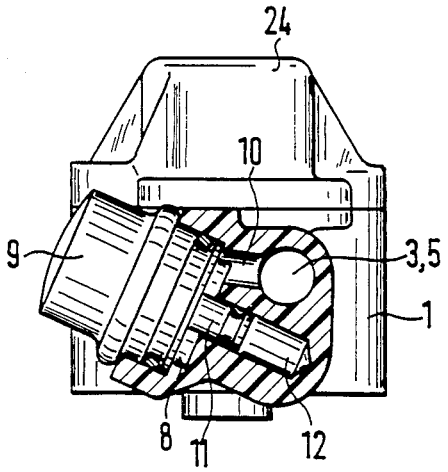
FIG. 6 is a section taken along the line VI—VI of FIG. 1 showing the device with a pressure regulator.

The exemplary embodiment of the device according to the invention, shown in FIGS. 1–6, has a basic body 1, advantageously embodied as a plastic injection-molded part. A connection fitting 2 for a supply line 3 is provided on the basic body 1, communicating with a fuel supply source (not shown), such as a fuel pump that pumps fuel from a fuel container. A connection fitting 4 is also provided on the basic body 1, preferably on the end remote from the connection fitting 2; a return flow line 5 discharges into the connection fitting 4, which communicates with the intake side of the fuel pump or fuel container. A retaining bore 8 into which a pressure regulating valve 9 of a known type is inserted is provided in a receiving flange 7 of the basic body 1. There is a connecting conduit 10 from the fuel supply line 3 to the retaining bore 8, from whence an opening, not shown, leads into the interior of the pressure regulating valve 9. The fuel regulated in the pressure regulating valve 9 flows via a valve fitting 11 of the pressure regulating valve 9 to the connection fitting 4. The fuel supply line 3 and the return line 5 discharge downstream of all the fuel injection valves into the connecting conduit 10.

For guiding fuel injection valves 14 of internal combustion engine fuel injection systems, stepped receiving bores 15 are provided in the dimensionally stable basic body 1; each bore encompasses one fuel injection valve 14 and is open at both ends. In the exemplary embodiment shown, there are four receiving bores 15 in the basic body 1, serving to receive four fuel injection valves. Each receiving bore 15 has a discharge opening 18 in the vicinity of a bearing surface 15 of the basic body 1, for guiding an injection port element 17 of the fuel injection valve 14. Retaining flanges 21, for example, surrounding the receiving bores 15, are embodied on the face end 20 of the basic body 1 opposite the bearing face 16 are provided with two fastening openings 22, for example.

The device also has a plastic outlet strip 24, which is likewise dimensionally stable; plugs 25 are disposed on the outlet strip, each plug being associated with one fuel injection valve 14 and furnishing it with electrical contact. To this end, one plug socket 26, in the form of a blind bore open toward one end face 27 of the strip, is provided in the outlet strip 24 for each plug 25. First electrically conductive contact elements 28, for example in the form of known flat plugs, are disposed in the plugs 25 and are connected to electric leads 29 disposed in the outlet strip 24. The electric leads 29 may, for example, be in ribbon form and may be embedded in the plastic outlet strip 24. A connection plug 30, with which the individual electric leads 29 are connected and by way of which electric control signals for the fuel injection valves can be fed in from an electronic control unit of a known type, not shown, is also disposed on the outlet strip. Thus all the electric leads 29 extend from the connection plug 30 to the individual plugs 25 within the outlet strip 24, where they branch out to the individual first electrically conductive contact elements 28. Each plug opening 26 is surrounded on the end face of the outlet strip by outlet strip retaining flanges 32, in which fastening opening 33 are provided. Protruding from the outlet strip end face 27, spaced apart from one another, are two resiliently guided snap-lock arms 34, which are preferably integrally molded on when the outlet strip is made.

OPERATION

For assembling the device, one fuel injection valve 14 is inserted into each receiving bore 15 of the basic body 1 and comes to rest with a collar 36 on a shoulder, not shown, of the receiving bore 15, or else coming to rest in the manner shown on the end face 20 of the basic body 1, and the second electrically conductive fuel injection valve contact elements 37, embodied as plug contacts, protrude from the basic body 1. In the vicinity of the injection part 17, the fuel injection valve is provided with a sealing ring 38, which rest on the other end at the port opening 18. Toward the end face 20, the fuel injection valve is surrounded by a further sealing ring 39, which seals off the receiving bore 15 from the collar 36. When the outlet strip 24 is slipped with its end face 27 onto the end face 20 of the basic body 1, the first electrically conductive contact elements 28 of the outlet strip 24 slide over the second electrically conductive contact elements 37 of each fuel injection valve 14 and thereby assure the making of electrical contact for the fuel injection valves. At the same time as this electrical contact is made, the outlet strip 24 exerts a fastening force upon the fuel injection valves in the axial direction, for instance with a annular fastening groove 40 of the outlet strip 24 engaging the collar 36 of the fuel injection valve and exerting a fastening force upon this collar in the direction of the end face 20 of the basic body 1, so that each fuel injection valve is fixed in its position. When the outlet strip 24 is being mounted on the basic body 1, the snap-in arms 34 also engage detent openings 42 of the basic body 1 and with a detent protrusion 43 engage a detent edge 44 of the basic body 1 from behind, forming a snap-in connection that holds the basic body 1 and the outlet strip 24 together. A sealing ring 46, one of which surrounds each fuel injection valve, is disposed in a sealing groove 25 of the outlet strip 24 that is open toward the outlet strip end face 27; in the assembled state, the sealing ring rests on the end face 20 of the basic body 1 and prevents dirt and moisture from the outside from reaching the fuel injection valves disposed in the receiving bores 15. A sealing ring functioning in the same manner and surrounding all the fuel injection valves at once may be provided instead.

The fuel supply line 3 and the return line 5 are each guided in the basic body 1 such that they are open toward the various receiving bores 15. A filter 48 is for instance fitted onto the fuel injection valve 14; one edge 49 of the filter rests radially on the wall of the receiving bore 15 and extends between the fuel supply line 3 and the return line 5, thus dividing the receiving bore 15 into two separate chambers. The fuel supplied via the fuel supply line 3 flows via openings into the interior of each fuel injection valve, and from there some of the fuel can be injected via the injection port element 17 while the rest flows upward and via further openings into the vicinity of the receiving bore 15, which is contacted by the return line 5. In a simplified embodiment, the separate return line 5 can be omitted.

The device, assembled from the basic body 1 and the outlet strip 24 and provided with the fuel injection valves 14, can now be disposed as a unit in a testing apparatus in which the injection performance of the individual fuel injection valves is tested. If all the fuel injection valves are in accordance with the prescribed guidelines, then this finished device can be mounted as a unit on the engine, or on the intake tube of the engine, depending on the particular embodiments involved. To this end, the assembled device is placed with the bearing surface 16 of the basic body 1 against a bearing surface 50 of the engine or air intake tube 51, and screws 52, with which the device is attached to the engine, or to the intake tube 51 of the engine, and secured there are passed through the fastening openings 22 and 33, which are in alignment with one another, of the retaining flanges 21 and outlet strip retaining flanges 32. Sealing grooves 52 open toward the bearing face 16 serve to receive sealing rings 54 and effect sealing between the bearing surface 16 of the basic body 1 and the bearing face 50, by surrounding the injection openings 55 formed in the intake tube, into each of which openings one injection port element 17 of a fuel injection valve protrudes. The pressure regulating valve 9 likewise can be secured from the outset to the device, so that it can be mounted on the engine along with the device when the device is mounted on the engine. On the other hand, the pressure regulating valve 9 naturally can be inserted separately into the device and secured on it, subsequent to the mounting of the device on the engine, should this be desired.

The mounted device now needs only to be connected to the fuel source and to an electric plug, which via the common connection plug 30 delivers the control signals, arriving from the electronic control unit, for the individual fuel injection valves.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A device for retaining, supplying fuel to and providing electrical contact for electromagnetically actuatable fuel injection valves for fuel injection systems of internal combustion engines, having a dimensionally stable basic plastic body provided with stepped receiving bores for guiding the fuel injection valves, each of said bores open in the axial direction and arranged to surround one fuel injection valve which communicates with a fuel supply line, said valves brought into plug connection, by means of first electrically conductive contact elements disposed as plugs, with second electrically conductive contact elements of the fuel injection valves, further in which a contact-making outlet strip (24) is connected to the basic body (1), on which strip the plugs (25) are disposed in common, said outlet strip (24) further adapted to cover the receiving bores (15) and retain the fuel injection valves (14) in the receiving bores (15).

2. A device as defined by claim 1, in which the outlet strip (24) is embodied of plastic and is connectable to the basic body (1) by means of an electric snap-in connection (34, 43, 44).

3. A device as defined by claim 1, in which the basic body (1) and the outlet strip (24) can be affixed in common to the engine (51).

4. A device as defined by claim 1, in which electric leads (29) for electrical connection of the first electrically conductive contact elements (28) are disposed in the outlet strip (24) and are connected to a connection plug (30).

5. A device as defined in claim 1, in which at least one sealing ring (46) is disposed between the basic body (1) and the outlet strip (24).

6. A device as defined by claim 1, in which at least one connection fitting (2) for the fuel supply line (3) and one connection fitting (4) for a return line (5) are disposed on the basic body (1).

7. A device as defined by claim 1, in which a receiving flange (7) for a pressure regulating valve (9) is provided on the basic body (1).

* * * * *